US007654865B2

(12) United States Patent
Chazottes et al.

(10) Patent No.: US 7,654,865 B2
(45) Date of Patent: Feb. 2, 2010

(54) ELECTRICAL CONNECTOR

(75) Inventors: Frédéric Chazottes, Epernon (FR); Christian Campfort, Fresnay le Gilmert (FR)

(73) Assignee: FCI, Versailles (FR)

( * ) Notice: Subject to any disclaimer, the term of this patent is extended or adjusted under 35 U.S.C. 154(b) by 129 days.

(21) Appl. No.: 11/918,264

(22) PCT Filed: Apr. 11, 2006

(86) PCT No.: PCT/EP2006/003321

§ 371 (c)(1),
(2), (4) Date: Oct. 10, 2007

(87) PCT Pub. No.: WO2006/108610

PCT Pub. Date: Oct. 19, 2006

(65) Prior Publication Data

US 2009/0042434 A1 Feb. 12, 2009

(30) Foreign Application Priority Data

Apr. 11, 2005 (WO) ..... PCT/EP2005/005205

(51) Int. Cl.
*H01R 13/40* (2006.01)

(52) U.S. Cl. ..... 439/595

(58) Field of Classification Search ..... 439/595, 439/752, 680, 594

See application file for complete search history.

(56) References Cited

U.S. PATENT DOCUMENTS

| | | | | |
|---|---|---|---|---|
| 5,378,170 | A | 1/1995 | Abe et al. | 439/595 |
| 5,470,258 | A | 11/1995 | Suzuki et al. | 439/595 |
| 5,653,613 | A | 8/1997 | Shimoda | 439/752 |
| 6,183,303 | B1 | 2/2001 | Sato | 439/610 |
| 6,390,849 | B1 | 5/2002 | Yamanashi et al. | 439/595 |
| 6,913,494 | B2 * | 7/2005 | Ward et al. | 439/752 |

FOREIGN PATENT DOCUMENTS

| | | | |
|---|---|---|---|
| WO | WO2008007166 | * | 1/2008 |
| WO | WO2008010020 | * | 1/2008 |

* cited by examiner

*Primary Examiner*—Neil Abrams
*Assistant Examiner*—Phuong Nguyen
(74) *Attorney, Agent, or Firm*—Harrington & Smith, PC

(57) ABSTRACT

The electrical connector includes an electrical terminal, a housing delimiting a chamber for receiving the terminal along a reception direction (X), successively at a reception position and at a retained position, a pawl hinged to one amongst the housing and the terminal, and a stop fixed to the other amongst the housing and the terminal. Said pawl and stop cooperate for retaining the terminal at its retained position, and said housing includes a guiding wall with guiding surface on which the terminal is pushed against by the pawl being elastically pushed back. The guiding surface comprises a raising slope inclined toward the inside of the chamber along the reception direction (X) 1 the slope being located to be climbed on by the terminal pushed from its reception position to its retained position. Application in the automotive industry.

13 Claims, 5 Drawing Sheets

ELECTRICAL CONNECTOR

TECHNICAL FIELD OF THE INVENTION

The present invention relates to an electrical connector destined to connect electrical wires with pins, in particular a connector used in the automotive industry.

BACKGROUND OF THE INVENTION

A connector comprises a supporting housing carrying a set of terminals, each terminal being crimped with an electrical wire. The connector thus obtained is intended to be connected with a set of pins, for instance carried by a electrical board, each pin coming into contact with a terminal.

For mounting the connector, each terminal is first crimped to a wire, and then inserted into a receiving chamber of the housing. In the chamber, the terminal is retained by means of a pawl and a stop. Usually, the pawl is hinged to the housing and the stop is arranged on the terminal, although the pawl may be hinged to the terminal.

Several problems arise with current connectors.

During its insertion, the terminal strikes the base of the pawl and pushes it back elastically. Afterward, the terminal reaches a retained position where the pawl is released and retains the terminal from going backward the reception direction.

In order to avoid unwanted disengagement of the terminal, the pawl is generally made very stiff, which increase the insertion force needed to push it back. Stiffness can be obtained through thickness of pawl foot or through longer stroke of pawl.

Since terminals are usually inserted by human operator, the pawl cannot be made too stiff, and unwanted disengagement may still occur.

Moreover, the pawl often rests against the stop only with a limited area of its contact surface. This happens when the stop is shifted laterally relative to the pawl, for instance because of clearance.

Here again, this may lead to unwanted disengagement of the terminal.

Moreover, in case the connector is exposed to vibrations, it is preferred that the terminal when in its final position is held tightly. Therefore it is preferred that the terminal is adjusted with small clearance within the receiving chamber.

SUMMARY OF THE INVENTION

It is an object of the invention to provide a connector with an improved mounting process.

This object is achieved with an electrical connector comprising:

- an electrical terminal,
- a housing delimiting a chamber for receiving the terminal along a reception direction, successively at a reception position and at a retained position,
- a pawl hinged to one amongst the housing and the terminal, and
- a stop fixed to the other amongst the housing and the terminal, wherein:

- said pawl and stop cooperate for retaining the terminal at its retained position, and
- said housing comprises a guiding wall with a guiding surface on which the terminal is pushed against by the pawl being elastically pushed back, characterised in that said guiding surface comprises a raising slope inclined toward the inside of the chamber along the reception direction, the slope being located to be climbed on by the terminal pushed from its reception position to its retained position.

An advantage of the invention can be to obtain a good resistance to terminal disengagement, also referred to as retention force; another advantage is to allow holding the terminal with small clearance in its chamber; while nevertheless having a reduced terminal insertion force.

Other aspects of the invention may correspond to anyone of the features of claims 1 to 17.

Embodiments of the invention are described hereinafter, as non-limiting examples, with reference to the accompanying figures.

DETAILED DESCRIPTION OF THE FIGURES

Figure 1:
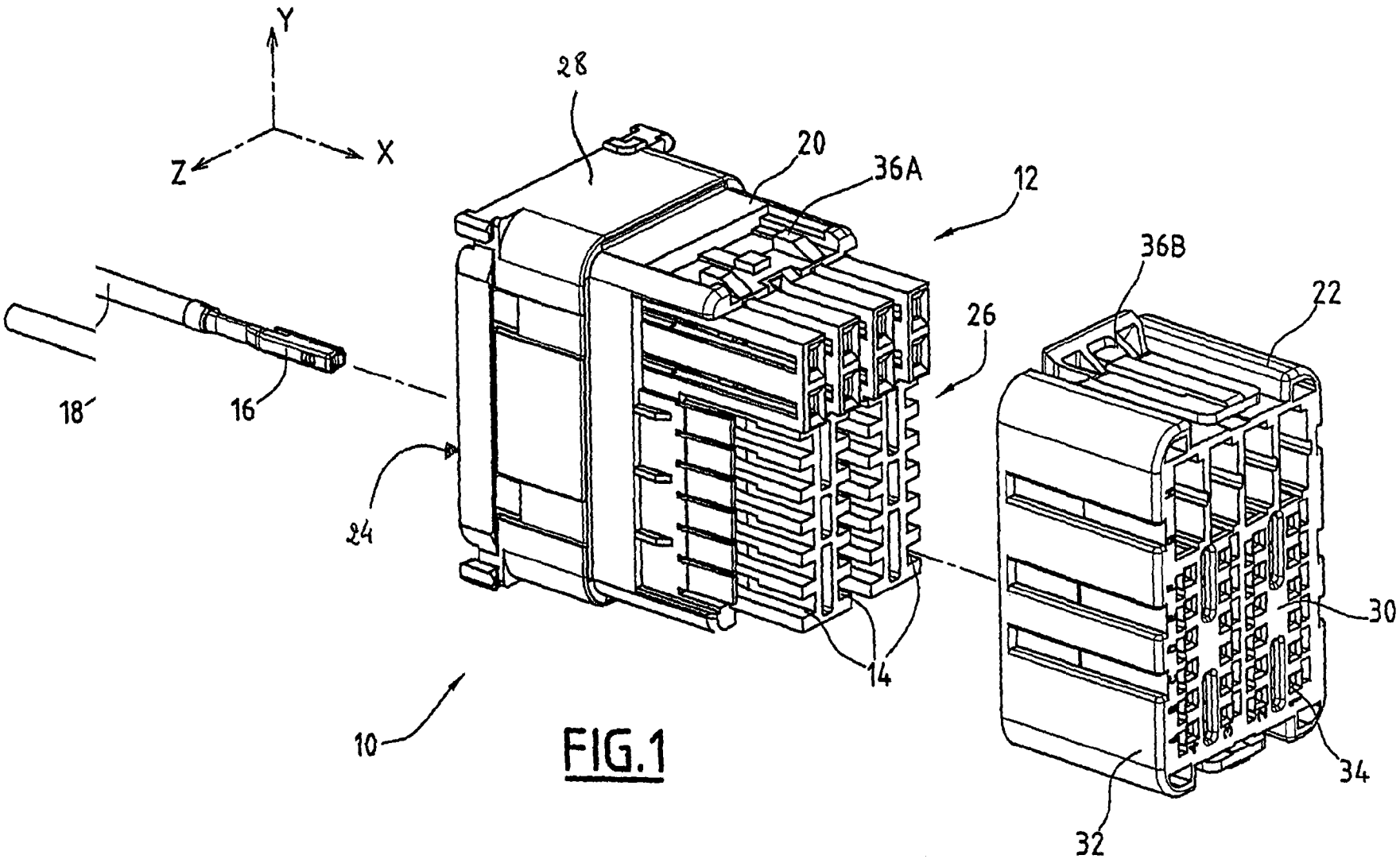
FIG. 1 is a partial exploded view of an electrical connector according to the invention.

FIG. 1 depicts an electrical connector 10 intended to mate with a counterpart connector (not shown) carrying a set of pins.

On the figures, the mating direction is referenced as X axis, which is oriented from the connector 10 towards the counterpart.

The electrical connector 10 comprises a housing 12, wherein a set of terminal receiving chambers 14 are formed and electrical terminals 16 crimped to electrical wires 18. Only one of the terminals is shown on the figures.

The terminal 16 has a well-known clamp form and will not be described further.

Two parts of the housing are represented: a main body 20 and a locking element 22.

The main body 20 has a general box form, with a back face 24 for inserting terminals 16, and a front face 26 intended to be covered by the locking element 22.

The back face 24 is surrounded by a protective skirt 28 and bored with terminal insertion holes (not visible), each leading to a chamber 14.

Thus, each chamber 14 starts from a terminal insertion hole 29 and comes out at the front face 26. The chambers 14 have rectangular cross-sections and are opened on one side near the front face 26, i.e. a lateral wall is partially missing.

The locking element 22 has the general form of a cap, and comprises a top wall 30 covering the front face 26 of the main body 20, and a skirt 32 extending backward from this top wall 30.

The top wall 30 is bored with pin insertion holes 34, each leading to a chamber 14.

The skirt 32 complements the main body 20 by forming the partially missing walls of the chambers 14.

The main body 20 and the locking element 22 are fixed together with help of complementary locking means 36A and 36B, respectively carried by the main body 20 and the locking element 22.

Figure 2:
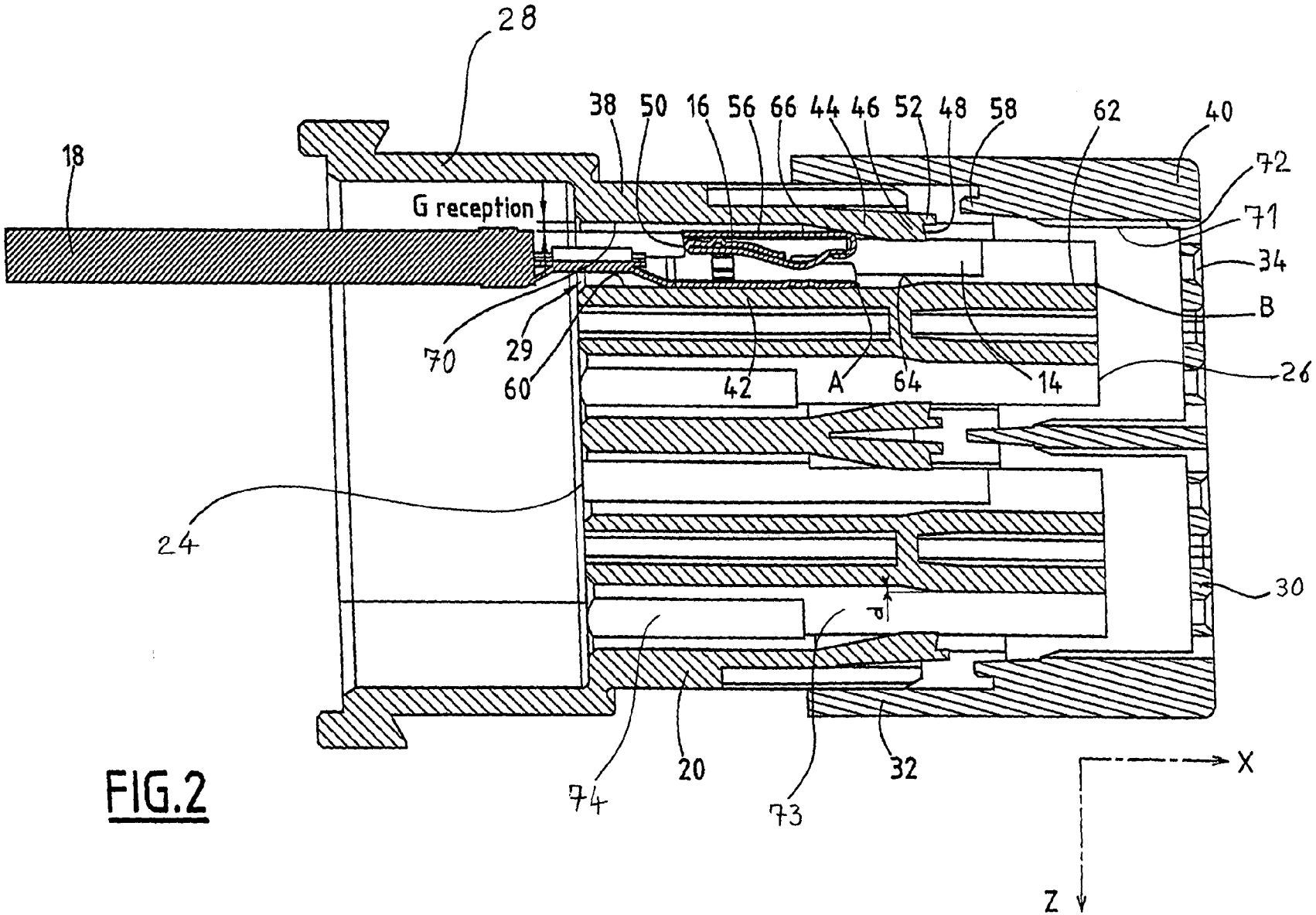
FIG. 2 is a sectional view of the pre-assembled connector shown on FIG. 1.

Now referring to FIG. 2, the receiving chamber 14 is delimited along the reception direction X on one side by two short walls 38 and 40, placed end to end, and on the other side by a long wall 42. The long wall 42 is then opposite both short walls 38 and 40.

The first short wall 38, i.e. the one extending from the terminal insertion hole 29, is part of the main body 20, whereas the second short wall 40, i.e. the one leading to the pin insertion hole 34, is part of the locking element 22. These two walls 38 and 40 are globally parallel to each and at the same level, relative to the insertion direction X. More precisely, the wall 38 has a internal face 70 in front of the wall 42 and the wall 40 has an internal face 71 in front of the wall 42, the faces 70 and 71 being essentially aligned.

Walls 42 and 38 of chamber 14 are linked by side walls 73 which are partially cut by a groove 74 for receiving part of the wire in case the wire diameter is greater than the width of the terminal.

A pawl 44, hinged to a front end of the first short wall 38, takes an oblique course both in the reception direction X and toward the inside of the chamber 14. The pawl 44 comprises a free end 46 delimiting a contact surface 48, for cooperating with a stop back face 50 of the terminal 16 to retain the terminal 16 at a retained position. A transverse holding lug 52 extends from the contact surface 54 in the reception direction X, for facing a side face 56 of the terminal 16 opposite the pawl 44, when the terminal 10 is at its retained position.

The second short wall 40 comprises a locking lug 58 for preventing the pushing back of the pawl, once the housing 12 is assembled.

A recess 72 is cut on a side of face 71 to allow introduction between the terminal and the locking piece 22 of the tool used to act on the pawl to unlock the terminal.

The long wall 42 has a longitudinal profile that comprises a reception stage 60 and a retained stage 62 parallel to each other, these stages being connected by a slope 64 inclined toward the inside of the chamber 14 along the reception direction X, that means that the stages 60, 62 are offset of a distance d (FIG. 2). The long wall 42 is intended to guide the terminal 16 during it reception in the chamber 14. In the following description, it will be referred to as the guiding wall 42.

First short wall 38 and guiding wall 42 are distant to each other such that a reception gap $G_{reception}$ is defined perpendicularly to the reception direction X between the terminal 16 at its reception position, when it is urged against the wall 42, and a hinged end 66 of the pawl 44, where the pawl is linked to the face 70. The reception gap $G_{reception}$ can correspond to about than 10% of the distance between the guiding wall 42 and the hinged end 66.

Moreover, a retained gap $G_{retained}$ is defined perpendicularly to the reception direction X between the terminal 16 at its retained position and the second short wall by less than 5% of the distance between the guiding wall 42 and the second short wall 40 so that the terminal 16 is tightly confined. This ensures that limited vibration of the terminal will occur.

Because of the slope, the distance between the guiding wall 42 and the first short wall 38 is strictly greater than the distance between the guiding wall 42 and the second short wall 40 by more than 10%.

The assembling of the connector 10 is now explained with reference to FIGS. 2 and 3.

The terminal 16 is inserted into the receiving chamber through the insertion hole 29, then it comes in touch with the pawl and is urged against the reception stage, so as to reach a reception position, in which the terminal 16 lies on the reception stage. The reception gap $G_{reception}$ is such that the terminal 16 strikes the pawl 44 at about a third of the length of the pawl 44, thus providing a good lever arm so that only a low insertion force is needed to push back the pawl 44. This configuration is shown on FIG. 2.

The terminal 16 is then further inserted along the reception direction X. It slides against a guiding surface such that the terminal is pushed against this guiding surface by the pawl being elastically pushed back. On FIGS. 2 and 3, this guiding surface is depicted by points A and B: the guiding surface extends from point A to point B, along the reception direction X. The guiding surface comprises the slope 64.

Figure 3:
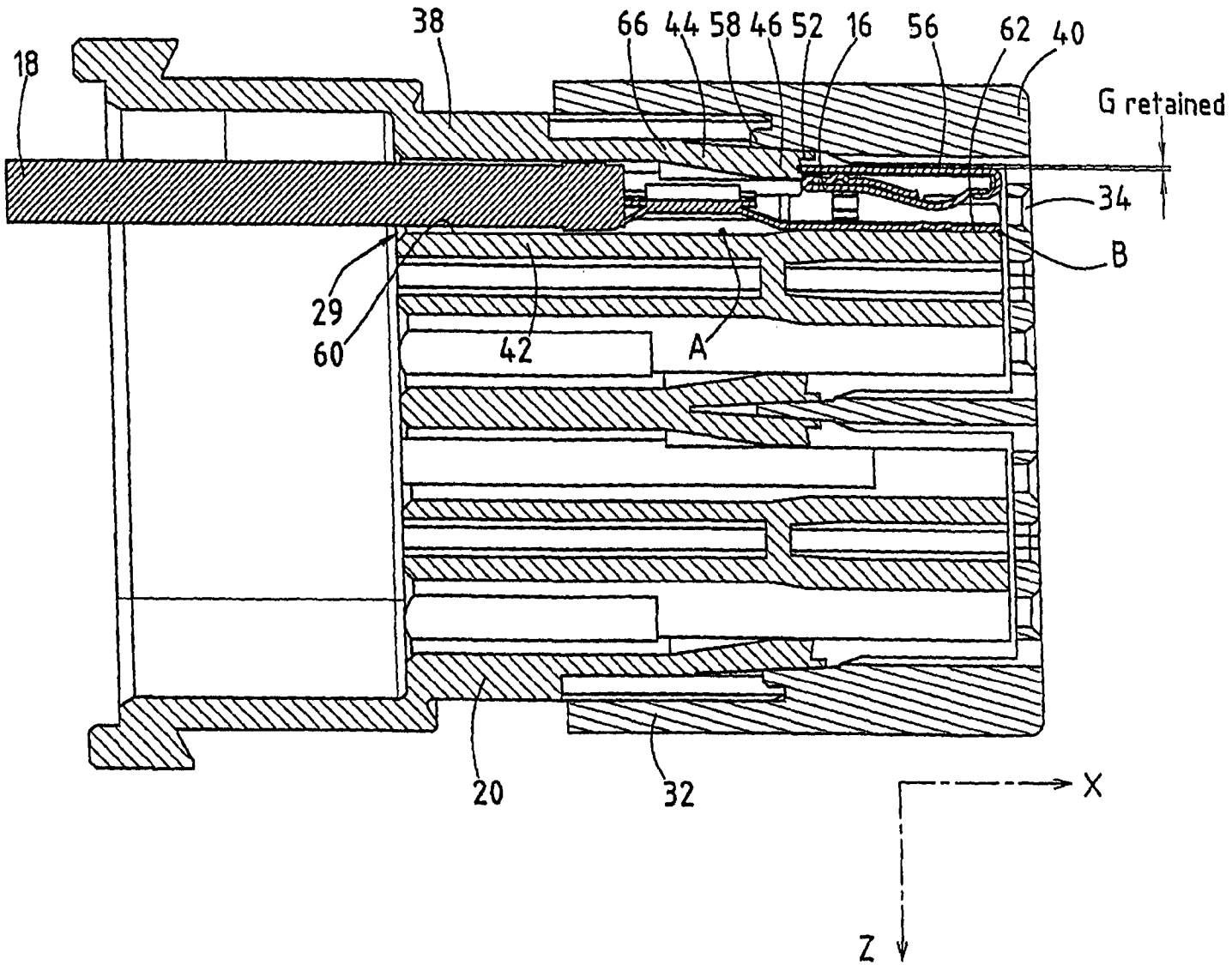
FIG. 3 is a sectional view of the assembled connector shown on FIG. 1.

Once the terminal 16 reaches point B, as on FIG. 3, the pawl is released and retains the terminal, thanks to the cooperating contact surface 48 of the pawl 44 and stop back face 50 of the terminal 16. In this configuration, the terminal 16 is at its retained position and lies on the retained stage 62 of the guiding wall 42.

The locking element 22 is then pushed backward against the main body 20 so that the locking lug 58 slides behind the pawl 44 in order to prevent prevent further pushing back of the pawl 44. This configuration is shown in FIG. 3.

Figure 4:
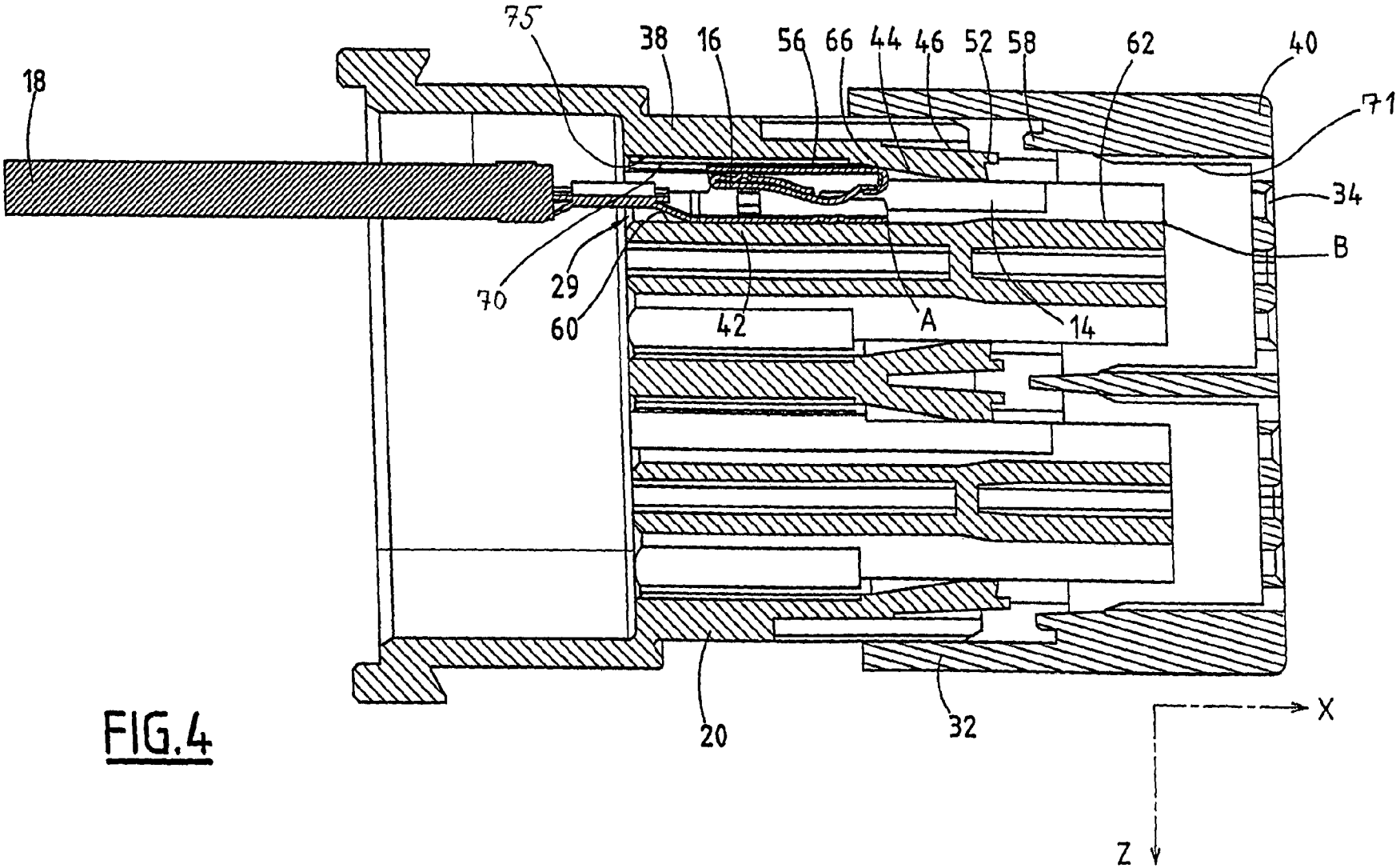
FIGS. 4 and 5 are views similar to FIGS. 2 and 3 showing another embodiment of the invention.
Figure 5:
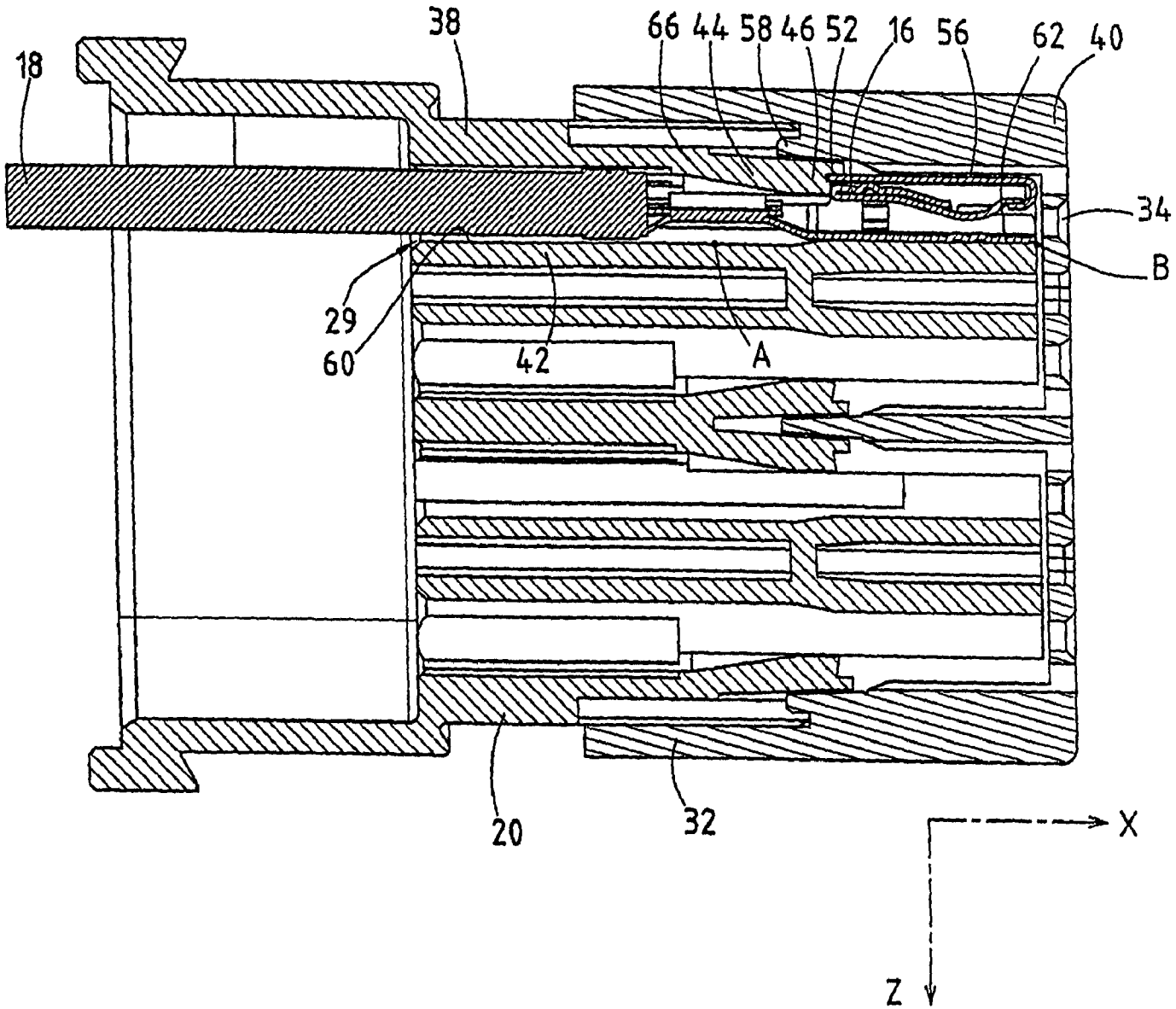

In the embodiment shown in FIGS. 4 and 5, the main difference with respect to the first embodiment is that the first short wall 38, and thus the pawl 44, are arranged so that the reception gap $G_{reception}$ is non-existent, or reduced to a minimum gap corresponding to the making tolerance. This means that the faces 70 and 71 are no more aligned as in the previous embodiment, but are offset of a distance essentially equal to the offset d between the stages 60, 62.

A small groove 75 can be cut in part of the face 70 to have supplemental space for the crimp region of the cable.

When the terminal is introduced in the chamber, the terminal being closely fitted in the chamber, it strikes the foot of the pawl as in usual connector, therefore with the usual force value. Pushed further it climbs on the slope pushing the pawl with a supplemental stroke approximately equal to the offset d. This way the force urging the pawl against the terminal can be greater, or the thickness of the pawl can be reduced for the same stiffness.

The distance perpendicularly to the reception direction X between any point of the contact surface 48 and the retained stage 62 can be smaller than the size of the terminal 16 perpendicularly to the reception direction.

Moreover, the distance perpendicularly to the reception direction X between the transverse holding lug 52 and the retained stage 62 can be smaller than the size of the terminal 16 perpendicularly to the reception direction X.

This ensures that the transverse holding lugs 52 of the pawl 44 lies on the side 56 of the terminal 16 at its retained position, and that the whole contact surface 48 is used.

As shown for each embodiment, a connector according to the invention reduces the probability of unwanted disengagement of the terminal.

It will be noted however that the two previous embodiments can easily be combined, and that other embodiments can be found without departing from the scope of the invention.

Further the invention can be implemented in a similar way for connector where the chamber is made in a single part including the walls 38, 40 and 42, most of locking part 22 being integrated with the housing 20.

The invention claimed is:

1. Electrical connector comprising:

an electrical terminal, a housing delimiting a chamber for receiving the terminal along a reception direction (X), successively at a reception position and at a retained position, a pawl hinged to the housing, and a stop on the terminal, wherein:

said pawl and stop cooperate for retaining the terminal in its retained position, said housing comprises a guiding wall with a guiding surface against which the terminal is pushed by the pawl being elastically pushed back, said guiding surface comprising a raising slope inclined toward the inside of the chamber along the reception direction (X), wherein the pawl and the raising slope are located relative to each other such that the terminal first comes in touch with the pawl when the terminal is at its reception position and the raising slope is located to be subsequently touched and climbed on by the terminal when the terminal is pushed from its reception position towards its retained position.

2. Electrical connector according to claim 1, characterised in that a retained gap ($G_{retained}$) is defined perpendicularly to the reception direction (X) between the terminal at its retained position and a wall opposite the guiding wall, wherein the retained gap is less than 5% of the distance between the guiding wall and the opposite wall.

3. Electrical connector according to claim 1, wherein the pawl is hinged to a wall of the housing opposite the guiding wall, and in that the stop is constituted by a back face of the terminal, according to the reception direction (X).

4. Electrical connector according to claim 3, wherein the slope ends before or at a point of the guiding wall opposite a free end of the pawl, according to the reception direction (X).

5. Electrical connector according to claim 3, wherein a reception gap ($G_{reception}$) is defined perpendicularly to the reception direction (X) between the terminal at its reception position and a hinged end of the pawl, so that the terminal strikes the pawl at more than a third of the length of the pawl.

6. Electrical connector according to claim 5, wherein the reception gap ($G_{reception}$) corresponds to more than 10% of the distance between the guiding wall and the hinged end.

7. Electrical connector according to claim 3, wherein the guiding wall comprises a flat reception stage, on which the terminal, lies at its reception position, a flat retained stage, on which the terminal lies at its retained position, reception and retained stages being connected by the slope, and wherein the pawl comprises a free end delimiting a contact surface for cooperating with the stop, and in that the distance perpendicularly to the reception direction (X) between any point of the contact surface and the retained stage is smaller than or the same as the size of the terminal perpendicularly to the reception direction (X).

8. Electrical connector according to claim 7, characterised in that the pawl comprises a transverse holding lug extending from the contact surface in the reception direction (X), and in that the distance perpendicularly to the reception direction (X) between the transverse holding lug and the retained stage is smaller than or the same as the size of the terminal perpendicularly to the reception direction (X).

9. Electrical connector according to claim 8, characterised in that the slope ends before or opposite a point of the guiding wall opposite a free end of the pawl, according to the reception direction (X), when the terminal lies at its retained position.

10. Electrical connector comprising:

an electrical terminal, a housing delimiting a chamber for receiving the terminal along a reception direction (X), successively at a reception position and at a retained position, a pawl hinged to the housing, and a stop on the terminal, wherein:

said pawl and stop cooperate for retaining the terminal in its retained position, said housing comprises a guiding wall with a guiding surface against which the terminal is pushed by the pawl being elastically pushed back, said guiding surface comprising a raising slope inclined toward the inside of the chamber along the reception direction (X), wherein the pawl and the raising slope are located relative to each other such that the terminal first comes in touch with the pawl when the terminal is at its reception position and the terminal subsequently comes into contact with raising slope, wherein the raising slope is located to be contacted and climbed on by the terminal when the terminal is pushed from its reception position to its retained position, and wherein the terminal lies at its reception position between the guiding wall and a first opposite wall with a reception gap ($G_{reception}$) defined perpendicularly to the reception direction (X) between the terminal at its reception position and a hinged end of the pawl, which corresponds to about 10% or more of the distance between the guiding wall and the hinged end.

11. Electrical connector according to any claim 10, wherein the terminal lies at its retained position between the guiding wall and a second opposite wall, and in that the distance between the guiding wall and the first opposite wall is greater than the distance between the guiding wall and second opposite wall by more than 10%.

12. Electrical connector housing comprising:

a chamber for receiving an electrical terminal at a reception position and at a subsequent retained position;

a deflectable pawl extending into the chamber, wherein the pawl is adapted to engage a stop on the electrical terminal for retaining the terminal at the retained position; and a guiding wall with a guiding surface forming part of the chamber, wherein the guiding surface comprises a raising slope inclined toward an inside of the chamber, wherein the pawl is adapted to push the terminal against the raising slope, wherein the pawl and the raising slope are located relative to each other such that when the electrical terminal is inserted into the chamber the terminal touches the pawl at the reception position, and the raising slope is located to be subsequently touched and climbed on by the terminal when the terminal is pushed from its reception position towards the retained position.

13. Electrical connector comprising:

an electrical connector housing as in claim 12; and an electrical terminal located in the chamber.

* * * * *